United States Patent [19]

Ortloff

[11] Patent Number: 4,602,586

[45] Date of Patent: Jul. 29, 1986

[54] MOTION DECOUPLING MECHANISM FOR FLUID SWIVEL STACK

[75] Inventor: John E. Ortloff, Houston, Tex.

[73] Assignee: Exxon Production Research Co., Houston, Tex.

[21] Appl. No.: 685,884

[22] Filed: Dec. 24, 1984

[51] Int. Cl.[4] ..... B63B 21/00; B63B 27/30

[52] U.S. Cl. ..... 114/230; 285/136; 285/168; 441/5

[58] Field of Search ..... 114/230; 285/136, 168, 285/190, 282; 441/5

[56] References Cited

U.S. PATENT DOCUMENTS

| | | | |
|---|---|---|---|
| 998,883 | 7/1911 | Elvin | 285/168 |
| 3,605,415 | 9/1971 | Mohlman | 405/168 |
| 3,620,268 | 11/1971 | Paddington | 141/388 |
| 3,756,293 | 9/1973 | Adler | 141/388 |
| 3,782,458 | 1/1974 | Slack | 166/355 |
| 3,957,291 | 5/1976 | Edling et al. | 285/136 |
| 4,002,357 | 1/1977 | Bennett | 285/282 X |
| 4,069,529 | 1/1978 | Van Heijst | 441/5 |
| 4,100,752 | 7/1978 | Tucker | 405/170 |
| 4,126,336 | 11/1978 | Ortloff et al. | 285/136 |
| 4,206,782 | 6/1980 | Tuson | 137/615 |
| 4,262,380 | 4/1981 | Foolen | 441/3 |
| 4,299,261 | 11/1981 | Talafuse | 285/282 X |
| 4,318,423 | 3/1982 | DeGraaf | 137/615 |

FOREIGN PATENT DOCUMENTS

| | | | |
|---|---|---|---|
| 163263 | 5/1958 | Sweden | 285/168 |

OTHER PUBLICATIONS

J. E. Ortloff, "Swivels for Production Risers and Offshore Terminals", Journal of Energy Resource Technology, Dec., 1982, vol. 104, pp. 337–342.

*Primary Examiner*—Stephen Marcus
*Assistant Examiner*—Mark Thronson
*Attorney, Agent, or Firm*—David H. Vickrey

[57] ABSTRACT

A mechanism for decoupling over a selected angle the rotational motion between a marine vessel moored to a single point mooring system such as a single anchor leg mooring (SALM) and the fluid swivel stack of the single point mooring system. The mechanism includes two spaced-apart stops attached to the fluid swivel stack and a coupler positioned between the stops and attached to a mooring swivel at the base of the fluid swivel stack. Shock absorbers may be positioned on each stop between the coupler and each stop.

17 Claims, 7 Drawing Figures

MOTION DECOUPLING MECHANISM FOR FLUID SWIVEL STACK

FIELD OF THE INVENTION

This invention relates to an improved single point mooring system for offshore floating production and storage systems and offshore floating terminal systems. More particularly, the invention relates to a single anchor leg mooring assembly having a fluid swivel or a concentric fluid swivel stack which is partially decoupled from motions of the moored marine vessel.

BACKGROUND OF THE INVENTION

Offshore floating production and storage systems are often used in the recovering and processing of hydrocarbons from geological formations beneath the ocean floor. These systems usually include a production riser system, which provides conduits for transporting produced fluids from the ocean floor to a marine vessel for crude oil processing and storage. The production riser system may also include a method for anchoring the vessel. Production riser systems are particularly useful in water too deep for a production platform or too remote to run a pipeline to onshore processing and storage facilities.

Offshore floating production terminals are also used in the recovering and processing of hydrocarbons from subsea geological formations. Like floating production and storage systems, floating production terminals include a riser system that provides conduits for transporting fluids from the ocean floor to a marine vessel. However, the fluid transported from the ocean floor in a floating production terminal is crude oil which has been processed at another location, such as an offshore fixed platform or an onshore location, and is being pumped to an offshore storage vessel. Both offshore floating production and storage systems and offshore floating terminal systems require a method for anchoring the marine vessel during production or loading and a riser which houses the flowlines carrying the hydrocarbon fluids from the ocean floor to the marine vessel. In some offshore production systems (used hereinafter to collectively refer to both "offshore floating production and storage systems" and "offshore floating terminal systems"), the riser is designed to be part of the anchoring system for the marine vessel. Such systems may be referred to as single point mooring systems. A particular single point mooring system is the single anchor leg mooring ("SALM") system.

A typical offshore production SALM is attached by a universal joint to a base which is fixed to the ocean floor. The base may be a simple anchoring device to which flowlines can be laid from an underwater production manifold, a single wellhead or multiple wellheads. A riser structure housing the required fluid conduits extends up through the water from the universal joint at the base to a buoy which reaches above the water surface. In some SALM installations, especially those in water depths of three hundred feet or more, a second universal joint between the riser pipe and the buoy may be installed. Above the buoy, a mooring swivel and a fluid swivel stack are rotatably mounted on top of the SALM. An example of a fluid swivel stack may be found in U.S. Pat. No. 4,126,336 to Ortloff et al. The fluid conduits carried by the riser structure extend from the base to the fluid swivel stack at the top of the buoy. Flexible components permit the fluid conduits to bend as required at the universal joints as they flex in response to the marine vessel movement. Fluid conduits, connected to each swivel of the fluid swivel stack, transport produced oil and gas from the swivel stack to a marine vessel. The marine vessel is moored to the SALM by a rigid yoke or arm. One end of the rigid arm is attached to the marine vessel. The other end of the arm is fastened, usually by a hinge mechanism, to the mooring swivel of the offshore production system.

To prevent twisting and breaking of the fluid conduits running from the fluid swivel stack to the moored marine vessel, the mooring swivel and the fluid swivel stack are joined so they will rotate together about the longitudinal axis of the SALM buoy. Therefore, as the marine vessel and rigid mooring arm rotate horizontally about the longitudinal axis of the SALM buoy, the end of the mooring arm connected to the mooring swivel causes the mooring swivel and attached fluid swivel stack to rotate about the SALM axis.

To prevent leakage of produced fluids and protect the internal components of each fluid swivel, elastomeric seals are placed in each swivel between the housing and the swivel shaft. The swivel shafts are stationary with respect to the riser and the swivel housings rotate with the vessel as it rotates about the substantially vertical axis of the SALM buoy. Typically, lip-type seals of synthetic rubber, neoprene, fluorocarbon or teflon are used in such applications. However, as the fluid swivels rotate in response to marine vessel movement, these seals wear. Worn seals may leak produced fluids as well as cause bearing failure and impede free rotation of the fluid swivels on the shaft. Replacing fluid swivel seals may result in costly downtime and repair. Reduced rotational movement of the swivel stack would increase fluid swivel seal life by reducing fluid swivel seal wear.

SUMMARY OF THE INVENTION

The current invention is a mechanism which decouples over a selected angle the rotational motion between a marine vessel moored by a connecting arm to the mooring swivel of a single point mooring system and the fluid swivel stack of the single point mooring system. In the invention, a stop means is affixed to the fluid swivel stack and a coupling means is affixed to the mooring swivel and adapted to engage the stop means to limit the rotational motion to the selected angle. In a preferred embodiment, two spaced-apart stops are attached to the single point mooring system fluid swivel stack. A mooring swivel, having a coupling means positioned between the stops, is rotatably mounted on the single point mooring system. In an additional preferred embodiment, shock absorbers are placed on the stops between the coupling means and the stops. In the most preferred embodiment, the mooring swivel can rotate plus or minus about ten degrees before the coupling means engages one of the stops causing the fluid swivel stack to rotate about the single point mooring system.

DETAILED DESCRIPTION OF THE INVENTION

Figures 1, 2:
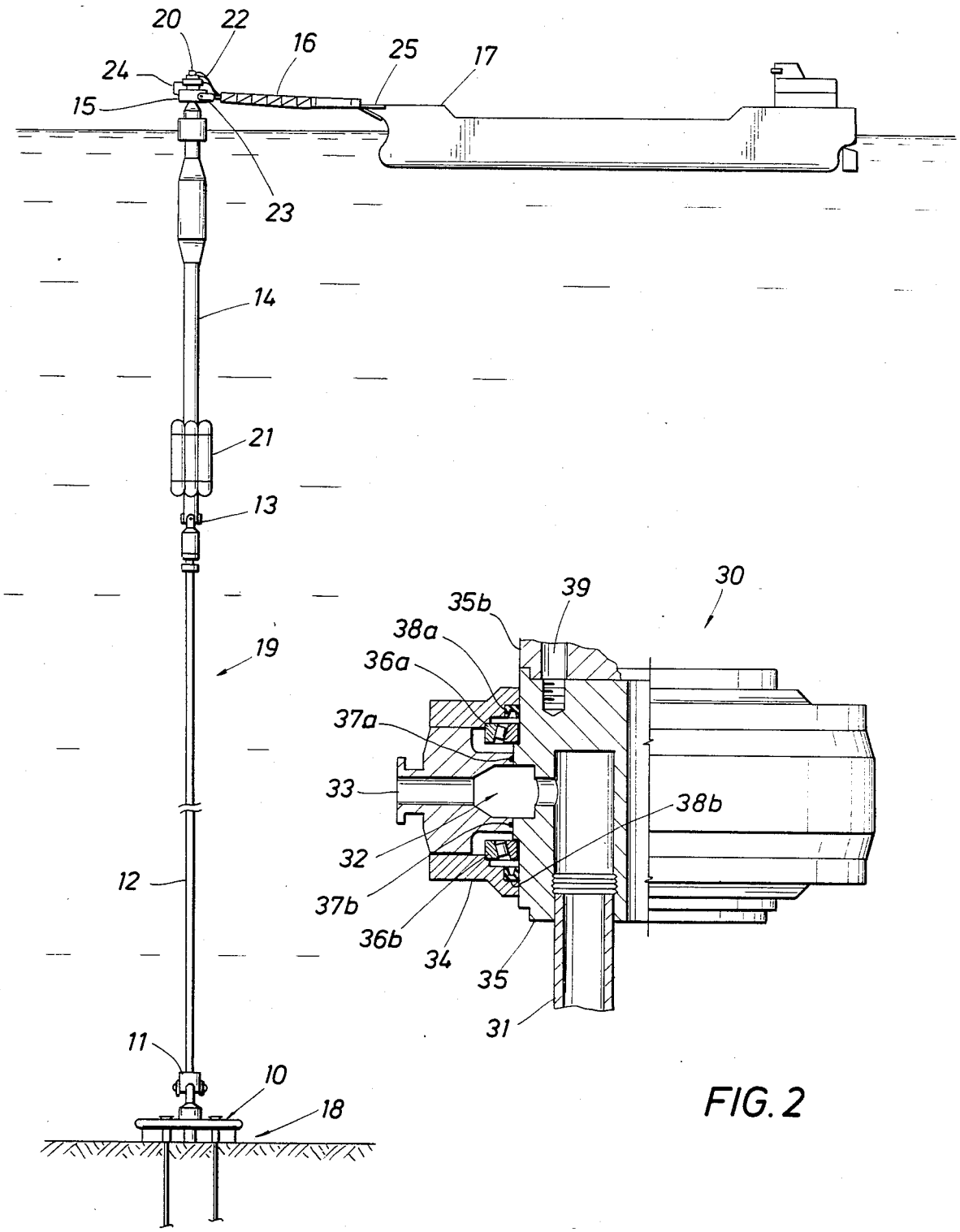
FIG. 1 is a schematic of a representative offshore production system employing a single anchor leg mooring assembly.
FIG. 2 is a cut-away schematic of a multiline modular concentric swivel for a fluid swivel stack for use in an offshore production system.

FIG. 1 is a typical offshore floating production system employing a single anchor leg mooring (SALM) system. In FIG. 1, the marine vessel 17 is held in a substantially fixed position over a preselected site, generally designated 18. The preselected site may be a wellhead, a production manifold or a gathering point for lines from many wells. The marine vessel may be used for storage or production and may be any suitable floating or floatable vessel. At the wellhead site 18, a riser system 19 is attached to an ocean floor base 10 by means of a first universal joint 11. Riser housing 12 which is connected to the base 10 by means of first universal joint 11 supports a plurality of flowlines or conduits. The upper end of housing 12 is connected to buoy 14 by means of a second universal joint 13. The riser system may be maintained under tension by the buoy 14 and, if needed, a reserve buoyancy chamber 21. A mooring swivel 15 is rotatably mounted on the upper end of the buoy 14. One end of connecting arm 16 is fastened to mooring swivel 15. The other end of connecting arm 16 is attached to marine vessel 17. Fluid swivel stack 20 is rotatably mounted above mooring swivel 15. In some embodiments, fluid swivel stack 20 may be comprised of only one fluid swivel. Fluid conduits 22, in fluid communication with the various swivels of fluid swivel stack 20 are run along rigid connecting arm 16 to marine vessel 17. One end of rigid connecting arm 16 is fastened to swivel 15 by means of hinge 23. The other end of one end of connecting arm 16 is fastened to marine vessel 17 by means of hinge 25. As marine vessel 17 and its rigid connecting arm 16 move vertically in response to wind, wave, current and other environmental forces, the marine vessel 17 and the rigid connecting arm 16 rotate vertically about hinges 23 and 25. Consequently, the remainder of the SALM system remains relatively static although it may be displaced at an angle from the vertical depending on the vessel's position relative to the longitudinal axis of the buoy 14. However, as marine vessel 17 and connecting arm 16 rotate horizontally about the longitudinal axis of the buoy 14, mooring swivel 15 also rotates. Due to connector 24 between mooring swivel 15 and the fluid swivel stack 20, the fluid swivel stack 20 also rotates in such instances. As discussed above, such rotational movement of fluid swivel stack 20 wears the internal seals in each fluid swivel. A typical internal seal configuration is further described in FIG. 2.

FIG. 2 is a schematic cut-away of a multiline modular concentric swivel of the type joined as in FIG. 1 to form fluid swivel stack 20. Fluid swivel stack 20 may be formed by joining swivel shaft module 35*a* to swivel shaft module 35*b* by connectors such as capscrew 39. When used as a product swivel, produced fluids flow from conduits in riser 12 and buoy 14 in FIG. 1 into inlet 31 of modular concentric swivel 30 of FIG. 2. The produced fluids then flow into annular passage 32 and out through outlet 33. By reversing flow, the swivel 30 can also be used for injection. Seals 37*a* and 37*b* maintain produced fluids or injected fluids in the flow assembly 31, 32, 33. Lubrication and environment seals 38*a* and 38*b* keep water, air and dust out of the swivel assembly 30. During operation, swivel body 34, containing outlet 33, rotates about swivel shaft 35*a* on bearings 36*a* and 36*b*. As illustrated in FIG. 1, rotational motion of the fluid swivels is caused by the horizontal motion of the mooring swivel 15, the connecting arm 16 and the attached marine vessel 17. Such rotational movement wears product seals 37*a* and 37*b* and lubrication and environment seals 38*a* and 38*b* which are illustrated in FIG. 2. Worn seals 37*a*, 37*b*, 38*a* and 38*b* require production downtime for disassembly, repair and replacement. The decoupling mechanism of this invention may be used to reduce rotational movement of fluid swivels. Three preferred embodiments of the current invention are individually represented in FIGS. 3, 4 and 5.

Figure 3:
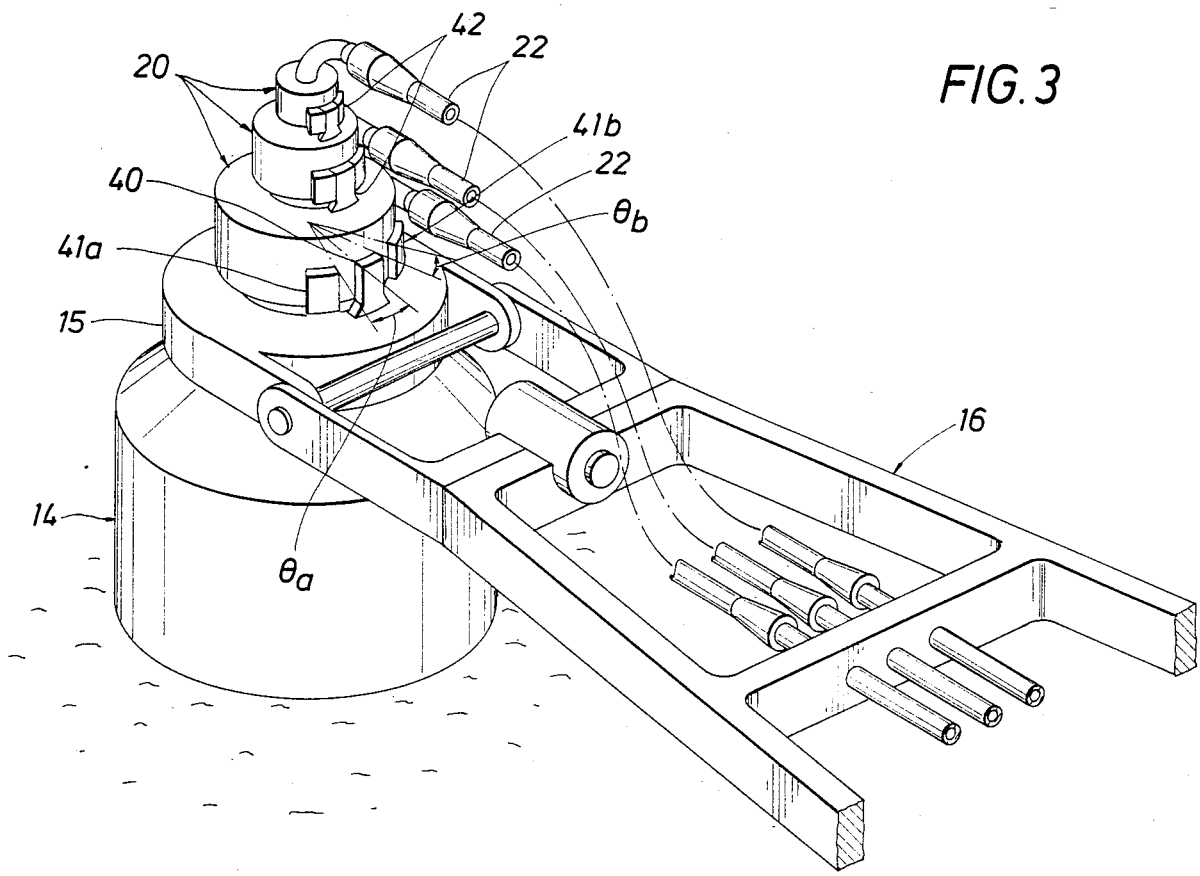
FIG. 3 is an isometric schematic of a mechanism for partially decoupling the rotational motion between a fluid swivel stack and a mooring swivel mounted on a single anchor leg mooring assembly employing flexible hoses as fluid conduits.

FIG. 3 is an isometric view of the above-water portion of an offshore production SALM system, including buoy 14, and an attached connecting arm 16. Although not shown, connecting arm 16 is attached to a marine vessel in a fashion similar to that illustrated in FIG. 1. The decoupling mechanism comprises coupling means 40 attached to mooring swivel 15 and stop means comprised of spaced-apart stops 41*a* and 41*b* attached to fluid swivel stack 20. Coupling means 40, such as a lug or a pin, is positioned between stop 41*a* and stop 41*b*. As long as the coupling means 40 does not contact either stop 41*a* or 41*b*, mooring swivel 15 will be free to rotate about the SALM longitudinal axis independently of the fluid swivel stack 20. Until coupling means 40 contacts either stop 41*a* or 41*b*, mooring swivel 15 will rotate in response to marine vessel movement while fluid swivel stack 20 remains static thereby reducing fluid swivel seal wear. However, when coupling means 40 contacts either stop 41*a* or 41*b*, the fluid swivel stack 20 will rotate due to fluid swivel interlocks 42. Flowlines 22 are attached to both the fluid swivels 20 and rigid connecting arm 16. While the fluid swivel stack remains relatively stationary during independent mooring swivel 15 and connecting arm 16 rotation, it is necessary to provide flowline flexibility to compensate for the relative movement between the portions of the flowline conduits 22 attached to rigid arm 16 and the portions of the flowline conduits 22 attached to fluid swivels 20. FIG. 3 illustrates the use of flexible pipes or hoses for flowline conduits 22.

Figure 6:
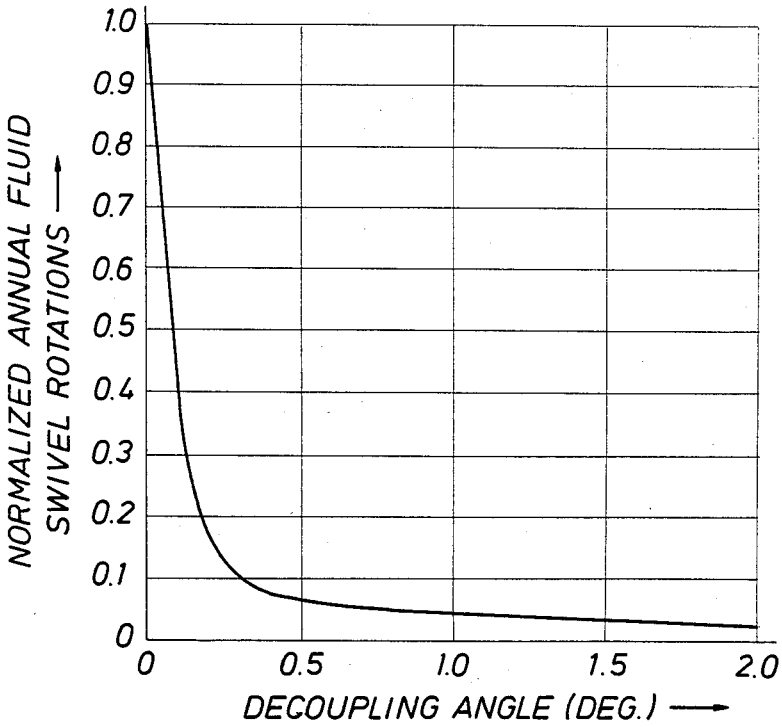
FIG. 6 is a plot of normalized swivel rotation versus decoupling angle (in degrees) based on model test data.

With further reference to FIG. 3, selected decoupling angles $\theta_a$ and $\theta_b$ are the angles about the SALM longitudinal axis defined by coupling means 40 and stops 41*a* and 41*b*, respectively. By subjecting a model marine vessel to simulated North Sea wave, wind and current conditions, it has been found that a decoupling angle of 0.5 degrees ($\theta_a=\theta_b=0.5°$) can reduce the cumulative annual fluid swivel rotation on the swivel shaft to about 7 or 8% of the amount of fluid swivel rotation when the decoupling angle is zero. FIG. 6 is a plot of normalized annual fluid swivel rotations as a function of the decoupling angle $\theta_a$, $\theta_b$ for a marine vessel moored to a SALM in the North Sea. The annual fluid swivel rotations plotted at FIG. 6 were normalized against the annual swivel rotations when the decoupling angle is zero. Referring to FIG. 6, when the decoupling angles are equal to 2° ($\theta_a=\theta_b=2°$), annual fluid swivel rotations are less than 5% the amount of such rotations when the decoupling angle is zero. Thus, selecting relatively small decoupling angles can substantially reduce fluid swivel rotation. Based on these data, it is anticipated that for most applications, selected decoupling angles of 10° ($\theta_a=\theta_b=10°$) or less for a total decoupling angle of 20° ($\theta_a+\theta_b=20°$) would be sufficient to substantially reduce fluid swivel rotation and increase fluid seal life.

Figure 4:
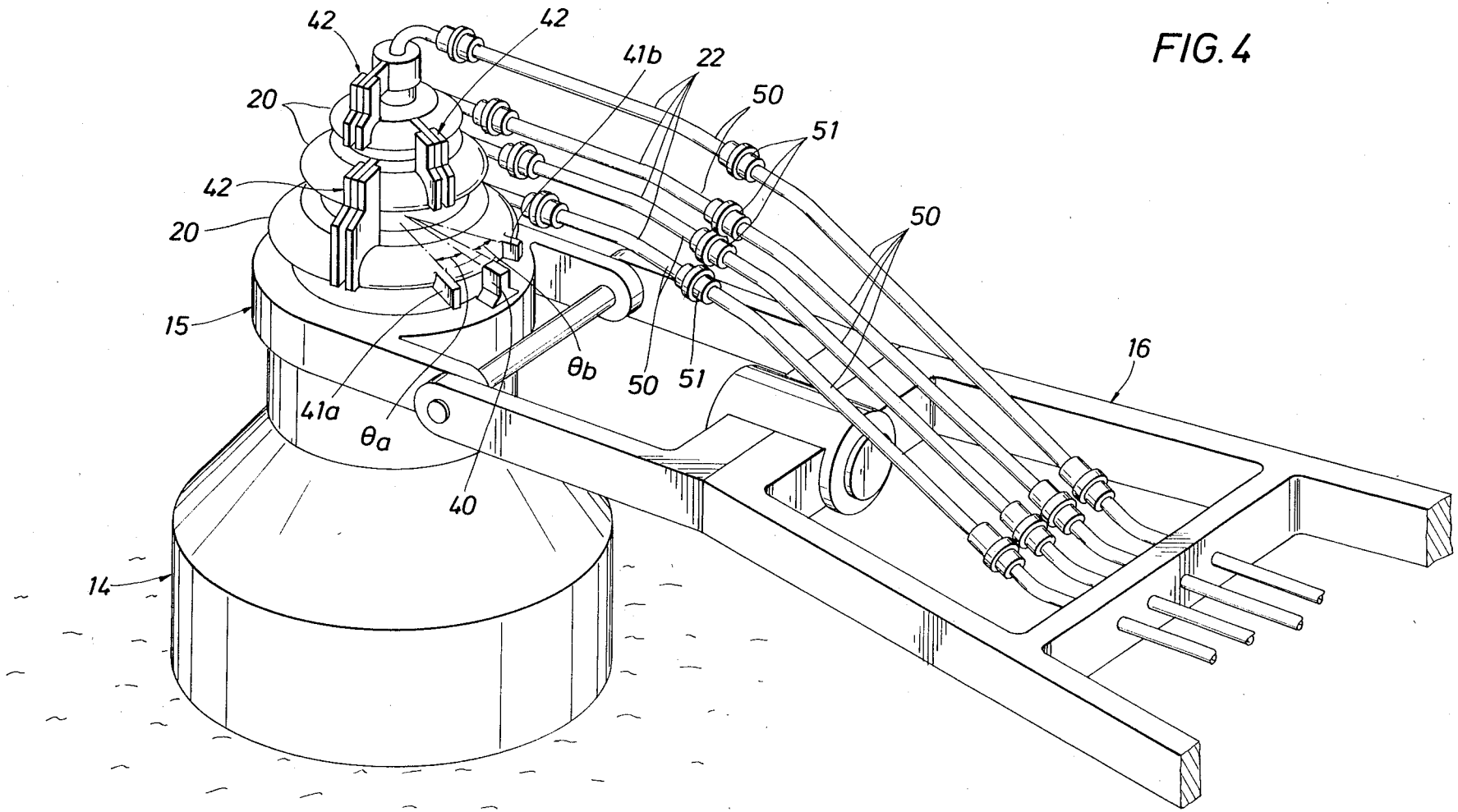
FIG. 4 is an isometric schematic of a mechanism for partially decoupling the rotational motion between a fluid swivel stack and a mooring swivel mounted on a single anchor leg mooring assembly employing rigid piping with flexible joints as fluid conduits.

FIG. 4 illustrates another embodiment of the current invention. Like FIG. 3, FIG. 4 is an isometric view of the above-water portion of an offshore production SALM system and an attached rigid connecting arm 16. The portion of connecting arm 16 not shown is attached to a marine vessel in a manner similar to that illustrated in FIG. 1. Again, the decoupling mechanism comprises coupling means 40, such as a lug or a pin, attached to mooring swivel 15 and stop means comprised of spaced-apart stops 41*a* and 41*b* attached to fluid swivel stack 20. Mooring swivel 15 is mounted on the SALM above buoy 14 and beneath fluid swivel stack 20. Coupling means 40 is positioned between stops 41*a* and 41*b*. Decoupling angles $\theta_a$ and $\theta_b$ are the angles about the SALM axis defined by the position of coupling means 40 and stops 41*a* and 41*b*. As long as neither $\theta_a$ nor $\theta_b$ is equal to zero, stops 41*a* and 41*b* are not contacted and fluid stack 20 remains stationary. However, when coupling means 40 engages either stops 41*a* or 41*b*, fluid swivel stack 20 is rotated about the SALM axis in concert with mooring swivel 15 due to fluid swivel interlocks 42. Flowline conduits 22 are comprised of rigid piping 50 and flexible joints 51. The flexible joints are necessary to compensate for the relative movement between flowline conduit 22 attached to fluid swivels 20 and flowline conduit 22 attached to connecting arm 16. Flexible joints 51 may be Lockseal Flexjoints® available from Murdock Machine and Engineering Company of Texas or other flexible connectors, such as ball joints.

Figure 5:
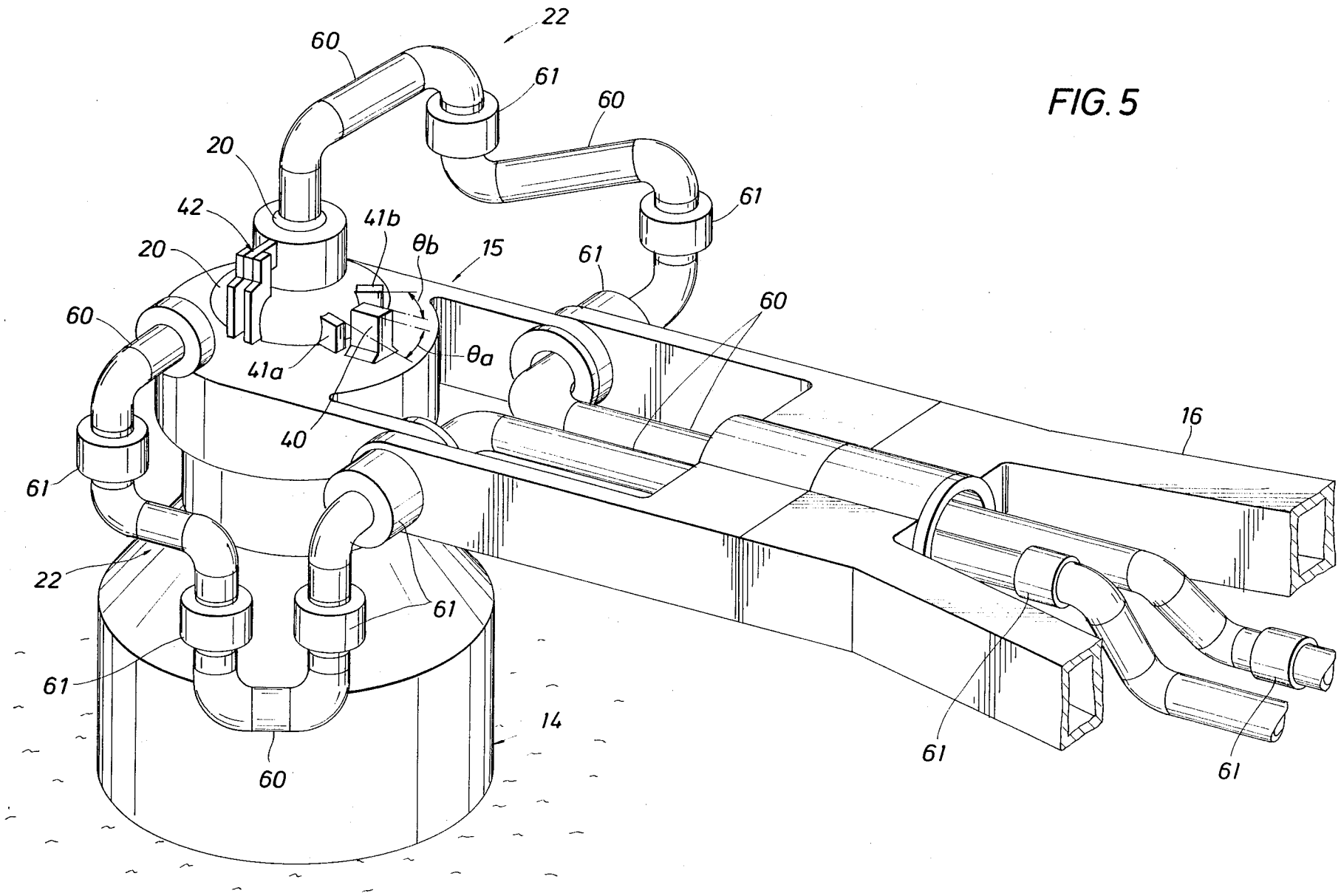
FIG. 5 is an isometric schematic of a mechanism for partially decoupling the rotational motion between a fluid swivel stack and a mooring swivel mounted on a single anchor leg mooring assembly employing rigid piping with swivels as fluid conduits.

FIG. 5 illustrates another embodiment of the current invention. As in FIGS. 3 and 4, FIG. 5 is an isometric view of the above-water portion of an offshore production SALM system and an attached rigid connecting arm 16. The portion of the connecting arm 16 not shown is attached to a marine vessel in a manner similar to that illustrated in FIG. 1. The decoupling mechanism comrises coupling means 40, such as a lug or a pin, attached to mooring swivel 15 and stop means comprised of spaced-apart stops 41*a* and 41*b* attached to fluid swivel 20. Mooring swivel 15 is mounted to buoy 14. The individual swivels of fluid-swivel stack 20 are connected by swivel stack interlocks 42. Flowline conduits 22 are attached to both the fluid swivel stack 20 and the connecting arm 16. To compensate for the relative motion between these two points of attachment during decoupled movement of connecting arm 16, a representative system of rigid piping 60 and in-line swivels 61 (such as Chiksan® available from FMC Corporation, Fluid Control Division) is illustrated in FIG. 5.

Figure 7:
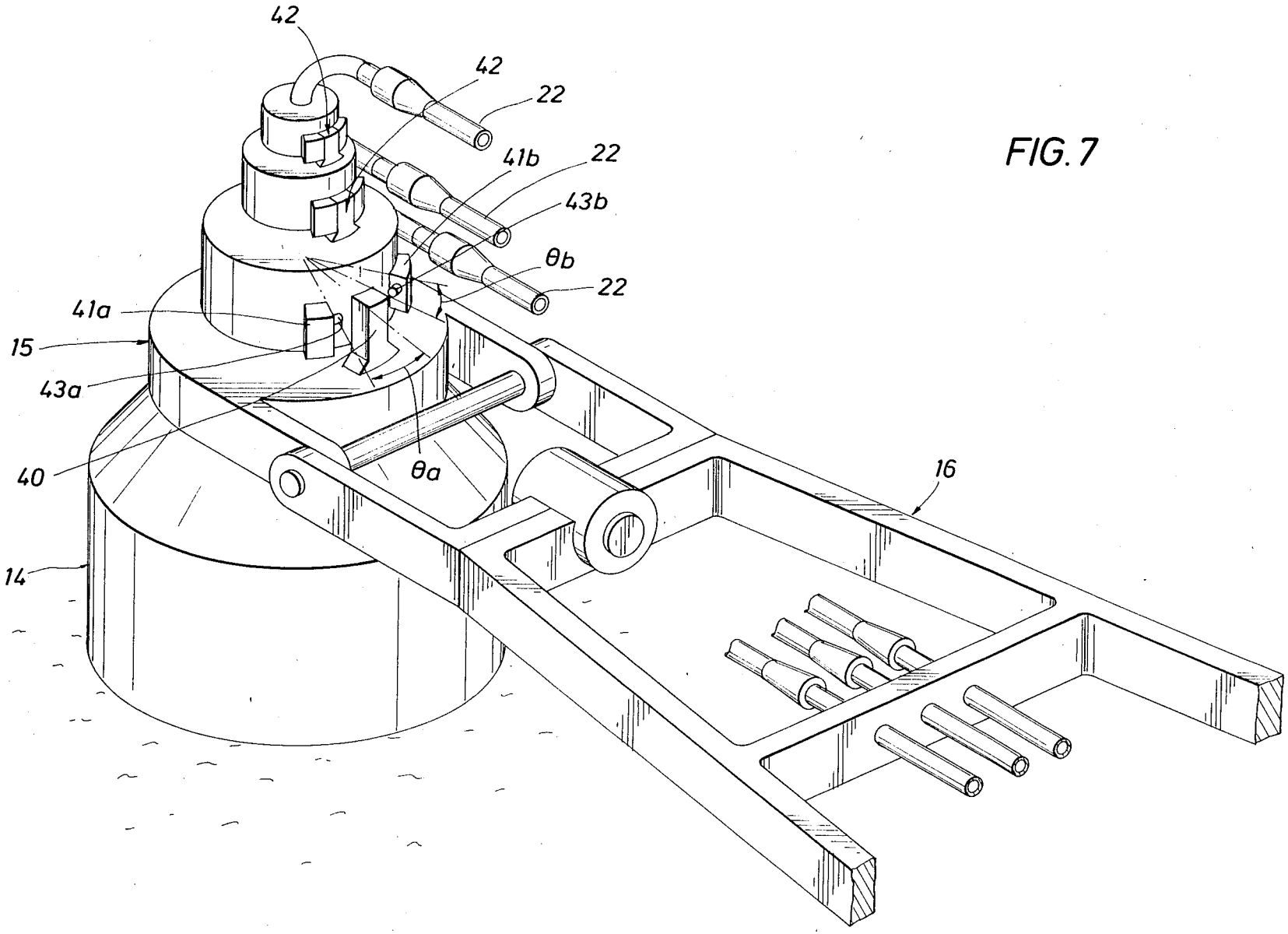
FIG. 7 is an isometric schematic of a mechanism for partially decoupling the rotational motion between a fluid swivel stack and a mooring swivel mounted on a single anchor leg mooring assembly having shock absorbers mounted on the stops of the decoupling mechanism.

FIG. 7 is an embodiment of the current invention identical to that of FIG. 3 with the addition of shock absorbers 43*a* and 43*b* on stops 41*a* and 41*b*, respectively. Similar shock absorber means may be added to any embodiment of the current invention to reduce jarring of the SALM and connecting arm 16 upon contact between coupling means 40 and stops 41*a* or 41*b*.

The current invention is a mechanism for decoupling over a selected angle the rotational motion between a marine vessel moored to a single point mooring system and the fluid swivel stack mounted on the single point mooring system. The mechanism comprises coupling means affixed to the mooring swivel of the single point mooring system and stop means affixed to the fluid swivel stack to limit the rotational motion to the selected angle. As long as the coupling means does not engage the stop means, the marine vessel, the connecting arm and the mooring swivel are free to rotate about the single anchor leg mooring while the fluid swivel stack remains stationary. However, when the coupling means engages the stop means, the fluid swivel stack rotates in concert with the mooring swivel in response to the movement of the marine vessel.

Various modifications and alterations in the practice of this invention will be apparent to those skilled in the art without departing from the scope and spirit of this invention. Although the invention was described in connection with specific preferred embodiments, it should be understood that the invention as claimed should not be unduly limited to such specific embodiments.

What we claim is:

1. A mechanism for decoupling over a selected angle the rotational motion between a marine vessel moored by a connecting arm to the mooring swivel of a single point mooring system and the fluid swivel stack of said single point mooring system, said fluid swivel stack having at least one fluid swivel, said mechanism comprising:

at least two spaced-apart stops affixed to said fluid swivel stack;

a coupler affixed to said mooring swivel to preclude rotational motion between said mooring swivel and said coupler and adapted to engage said stops to limit said rotational motion to said selected angle; and flexible fluid conduits, the first end of each said fluid conduit attached to and in fluid communication with a fluid swivel of said fluid swivel stack and the second end of each said fluid conduit attached to and in fluid communication with said marine vessel, said flexible fluid conduits adapted to accommodate the rotational motion between said fluid swivel stack and said marine vessel.

2. The mechanism of claim 1 wherein said flexible fluid conduits are hoses.

3. The mechanism of claim 1 wherein said stops are affixed to said fluid swivel stack and said coupler is affixed to said mooring swivel so that said selected angle is not more than 20°.

4. An apparatus for enabling rotational motion, over a selected angle, between the fluid swivel stack of a single point mooring system and the mooring swivel by which a marine vessel is moored to the fluid swivel stack through a connecting arm, the first end of said connecting arm attached to said mooring swivel and the second end of said connecting arm attached to said marine vessel, said fluid swivel stack having at least one fluid swivel, said apparatus comprising:

at least two spaced-apart stops affixed to said fluid swivel stack;

a coupler affixed to said mooring swivel to preclude rotational motion between said mooring swivel and said coupler and adapted for engaging said stops to limit said rotational motion to said selected angle; and flexible fluid conduits, the first end of each said fluid conduit attached to and in fluid communication with a fluid swivel of said fluid swivel stack and the second end of each said fluid conduit attached to and in fluid communication with said marine vessel, said flexible fluid conduits adapted to accommodate the rotational motion between said fluid swivel stack and said marine vessel.

5. The apparatus of claim 4 wherein said flexible fluid conduits are hoses.

6. The apparatus of claim 4 wherein said stops are affixed to said fluid swivel stack and said coupler is affixed to said mooring swivel so that said selected angle is not more than 20°.

7. The apparatus of claim 4 wherein said coupler is a lug.

8. The apparatus of claim 4 wherein said coupler is a pin.

9. A mechanism for partially decoupling the rotational motion between a marine vessel moored by an arm to the mooring swivel of a single point mooring system and the fluid swivel stack of said single point mooring system, said fluid swivel stack having at least one fluid swivel, said mechanism comprising:

at least two spaced-apart stops attached to said fluid swivel stack;

at least one coupler attached to said mooring swivel and positioned between said stops; and flexible fluid conduits, the first end of each said fluid conduit attached to and in fluid communication with a fluid swivel of said fluid swivel and the second end of each said fluid conduit attached to and in fluid communication with said marine vessel, said flexible fluid conduits adapted to accommodate said rotational motion between said fluid swivel stack and said marine vessel.

10. The mechanism of claim 9 further comprising shock absorbers attached to said stops between each said stop and said coupler.

11. The mechanism of claim 9 wherein said coupler is a lug.

12. The mechanism of claim 9 wherein said coupler is a pin.

13. The mechanism of claim 9 wherein said flexible fluid conduits are hoses.

14. A single point mooring system swivel assembly adapted for mooring to a marine vessel by means of a connecting arm attached to said marine vessel, said swivel assembly comprising:

a mooring swivel rotatably mounted on said single point mooring system and adapted to be fastened to said connecting arm;

a fluid swivel stack, having at least one fluid swivel, rotatably mounted on said single point mooring system, each swivel of said fluid swivel stack adapted for connection to and fluid communication with fluid conduits in fluid communication with said marine vessel;

at least two spaced apart stops affixed to said fluid swivel stack; and at least one coupler affixed to said mooring swivel said coupler positioned between said stops and adapted for engaging said stops to limit to a selected angle the rotational motion of said mooring swivel independent of said fluid swivel stack.

15. The swivel assembly of claim 14 wherein said fluid swivel stack is comprised of one fluid swivel.

16. The swivel assembly of claim 14 wherein said coupler is a lug.

17. The swivel assembly of claim 14 further comprising flexible fluid conduits, the first end of each said flexible fluid conduit attached to and in fluid communication with a fluid swivel of said fluid swivel stack and the second end of each of said flexible fluid conduit adapted to be in fluid communication with said marine vessel, said flexible fluid conduits adapted to accommodate the relative motion between said fluid swivel stack and said marine vessel.

* * * * *